US005899299A

United States Patent [19]

Chisum

[11] Patent Number: 5,899,299

[45] Date of Patent: May 4, 1999

[54] TILTABLE VEHICLE LIFT

[76] Inventor: Finis Lavell Chisum, Rt. 4, Box 225B, McAlester, Okla. 74501

[21] Appl. No.: 08/878,639

[22] Filed: Jun. 19, 1997

[51] Int. Cl.[6] ..... B66F 7/28

[52] U.S. Cl. ..... 187/216; 187/221

[58] Field of Search ..... 187/207, 211, 187/221, 216, 217, 218; 254/89 H, 93 H; 72/305

[56] References Cited

U.S. PATENT DOCUMENTS

| | | | |
|---|---|---|---|
| Re. 31,636 | 7/1984 | Chisum | 72/305 |
| 2,464,731 | 3/1949 | Thompson | 254/89 |
| 2,524,237 | 10/1950 | Smith | 254/89 |
| 2,577,378 | 12/1951 | Schultz et al. | 254/89 |
| 2,580,091 | 12/1951 | Hecker | 254/93 |
| 2,593,209 | 4/1952 | Smith | 254/89 |
| 2,961,069 | 11/1960 | Webster | 187/8.62 |
| 3,630,066 | 12/1971 | Chisum | 72/305 |
| 3,774,724 | 11/1973 | Feudale | 187/8.62 |
| 3,837,434 | 9/1974 | Clarke | 187/8.62 |
| 3,888,100 | 6/1975 | Chisum | 72/305 |
| 4,138,876 | 2/1979 | Chisum | 72/457 |
| 5,058,286 | 10/1991 | Chisum | 33/608 |
| 5,259,482 | 11/1993 | Proulx et al. | 187/8.62 |
| 5,341,575 | 8/1994 | Chisum | 33/608 |
| 5,355,711 | 10/1994 | Chisum | 72/457 |
| 5,417,094 | 5/1995 | Chisum | 72/34 |
| 5,522,145 | 6/1996 | Chisum | 33/288 |
| 5,524,395 | 6/1996 | Boiron | 187/221 |

*Primary Examiner*—Kenneth Noland
*Attorney, Agent, or Firm*—Head, Johnson & Kachigian

[57] ABSTRACT

A versatile tiltable vehicle lift capable of supporting a vehicle at a desired height. In its lowermost position, the lift tilts downwardly, thereby enabling a vehicle to be driven onto the lift. The tiltable feature of the lift eliminates the requirement that the device be retractable below floor level. The tiltable vehicle lift has an upper treadway frame for receiving and supporting a vehicle. An elevation means, typically a hydraulic cylinder, is pivotally connected between the rearward legs and the treadway frame. The tiltable vehicle lift is provided with a locking mechanism that safely maintains the vehicle lift at a desired height. The locking mechanism is comprised of an upper lock bar and a lower lock bar which may be engaged at any desired height of the vehicle lift. A means for disengaging the locking mechanism is provided so that the vehicle lift may be lowered.

10 Claims, 7 Drawing Sheets

TILTABLE VEHICLE LIFT

BACKGROUND OF THE INVENTION

1. Field of the Invention.

The present invention relates to a multi-use vehicle support and lift for raising vehicles to a desired working height to facilitate repairs for collision damage or to perform general repairs.

2. Description of Related Art.

During the 1970s, the United States automobile market was dominated by vehicles constructed with traditional framed chassis. Traditional frame construction uses a steel frame, usually under the vehicle, as a base to which the body and other components are affixed.

The middle of that decade witnessed many changes in the U.S. automobile market. The introduction and eventual explosion of unitized constructed vehicles led to greater competition between manufacturers. The technological improvements and consequent advantages of unitized construction in basic body design, the materials used, and the introduction of safety zones dramatically improved occupant safety. The ability of the foreign manufacturer to change a model's styling without the necessity of complete retooling was a major production advantage.

A variety of economic and regulatory factors forced the domestic manufacturers to move away from framed construction toward the unitized body in the late 1970s. By then most foreign manufacturers had perfected their production methods and had gained an increasing sales volume advantage over domestic manufacturers.

A more discerning public demanded increased active and passive safety in the automobile, and the uni-body constructed vehicle provided both.

In unitized constructed vehicles, the components of the inner and outer body function as the frame. A unitized constructed automobile body is produced with closer tolerances, and the main structure is constructed using high-strength low-alloy steel. Some manufacturers are beginning to use components of plastic for cosmetic panels. All these factors render the repair of the unitized constructed automobile extremely complex, even more so than the traditional repair techniques and processes required for full-framed vehicles. In many cases, less "power" is required by the body and frame alignment equipment to pull the unitized constructed vehicle back into alignment.

The move to the unitized constructed body by the domestic automobile industry and the inroads made in the U.S. market by foreign manufacturers have accelerated the need for multi-use products in collision repair facilities. These products must have the versatility and adaptability to function not only as body and frame alignment repair systems for both unitized and frame cars, but also must be capable of being employed in other avenues of repair and service. Collision repair equipment must now provide convenience of work flow through the repair facility, more comfortable working heights for the technicians to increase their productivity, less movement of the cars through the shops during repair, and (because of the multi-use capabilities) must cut the equipment investment costs to the facility.

Overall economic conditions of the collision repair industry in the U.S. and other countries have produced a need for more versatile body and frame alignment equipment, equipment that can be used for purposes other than body and frame alignment, such as use as a car lift. In the last few years, cars have become lighter in weight and smaller in size, making it all but impossible for a repair technician to do anything underneath or on the lower body section of the vehicle without raising the whole car up to a comfortable working height.

Prior lift devices have been constructed to accommodate portable pulling devices to be used to pull the frame and body into proper alignment when needed. In almost every instance, collision damaged vehicles must be raised one or more times during repair, although some may not need to be pulled with the pullers.

SUMMARY OF THE INVENTION

It is an object of this invention to provide a versatile tiltable vehicle lift capable of supporting a vehicle at a desired height. In its lowermost position, the lift tilts downwardly, thereby enabling a vehicle to be driven onto the lift. The tiltable feature of the lift eliminates the requirement that the device be retractable below floor level.

The tiltable vehicle lift has an upper treadway frame for receiving and supporting a vehicle. An elevation means, typically a hydraulic piston/cylinder, is pivotally connected between the rearward legs and the treadway frame. The elevation means is provided with a locking mechanism which safely maintains the vehicle lift at a desired height. The locking mechanism is comprised of an upper lock bar that may engage a lower lock bar at various orientations. A means for disengaging the lock bar is provided so that the vehicle lift may be lowered.

To facilitate the unique lifting configuration, the elevation means, which is pivotally affixed to the treadway frame, is additionally pivotally attached to rearward legs. The rearward legs are attached to the floor support in a manner that enables the rearward legs to be capable of vertical and horizontal movement.

In the preferred embodiment, the elevation means is positioned between the ends of the upper lock bar and the lower lock bar. The disengagement means is comprised of an auxiliary piston/cylinder that manipulates a pivotally mounted arm having rollers attached thereto. The pivotally mounted arm biases against the hydraulic piston/cylinder to disengage the upper lock bar from the lower lock bar. Once the upper and lower lock bars are disengaged, the lift may be lowered.

DETAILED DESCRIPTION OF THE PREFERRED EMBODIMENTS

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

Figure 1:
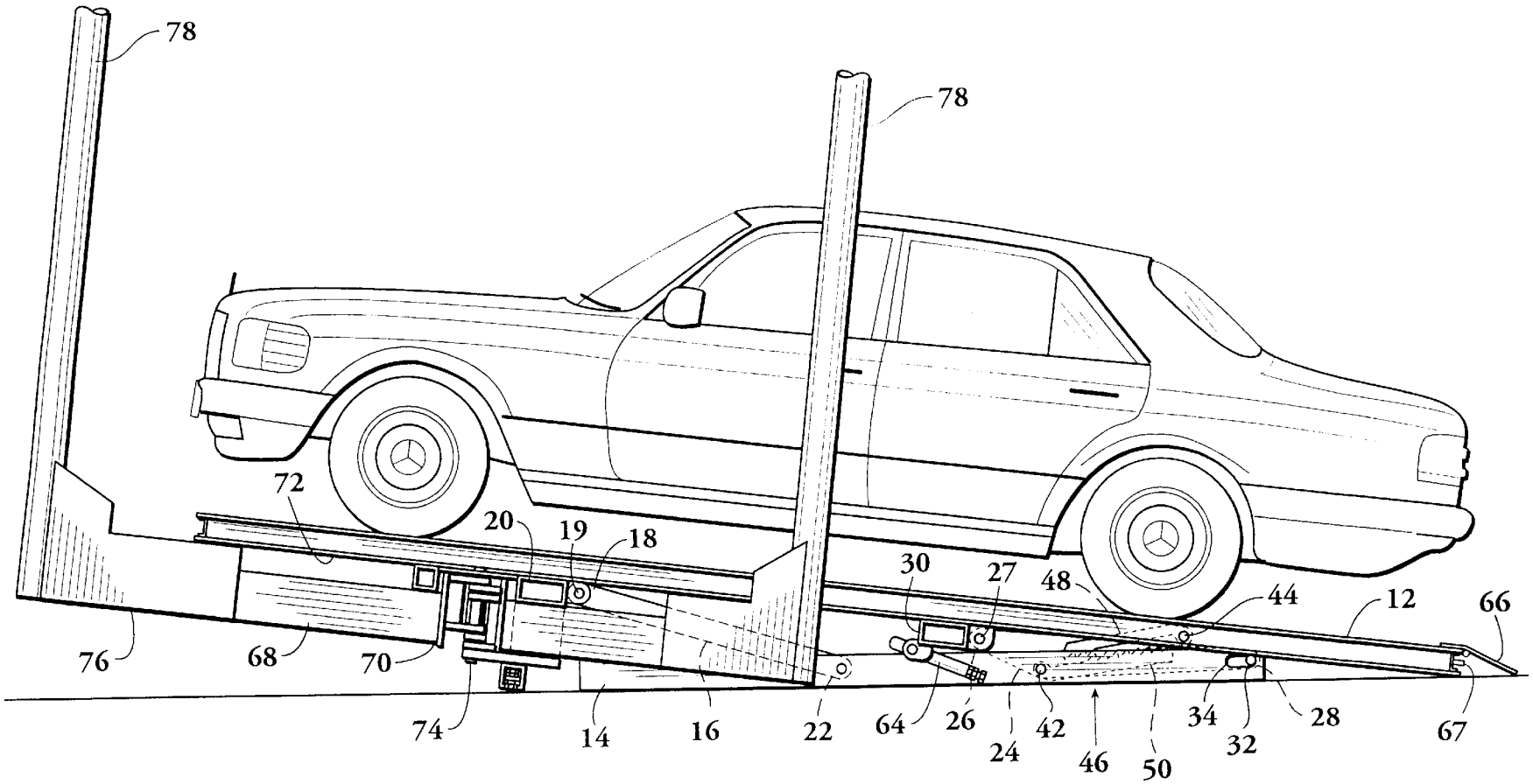
FIG. 1 is an elevation view of the tiltable vehicle lift in a first position with a vehicle thereon.
Figure 2:
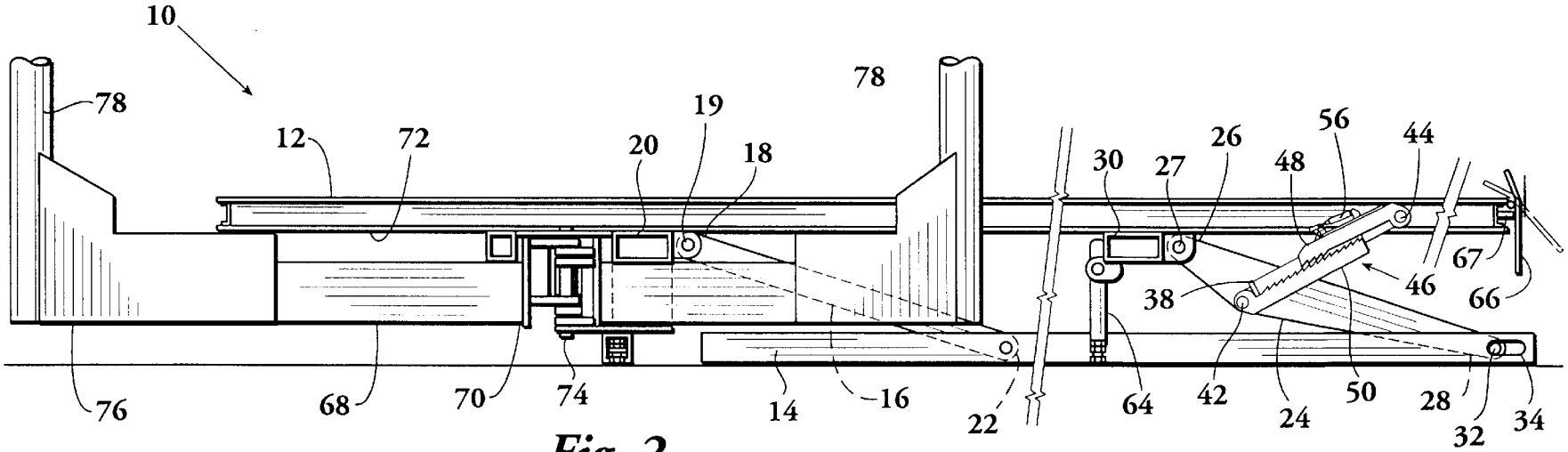
FIG. 2 is an elevation view of the tiltable vehicle lift in a second horizontal intermediate position.
Figure 4:
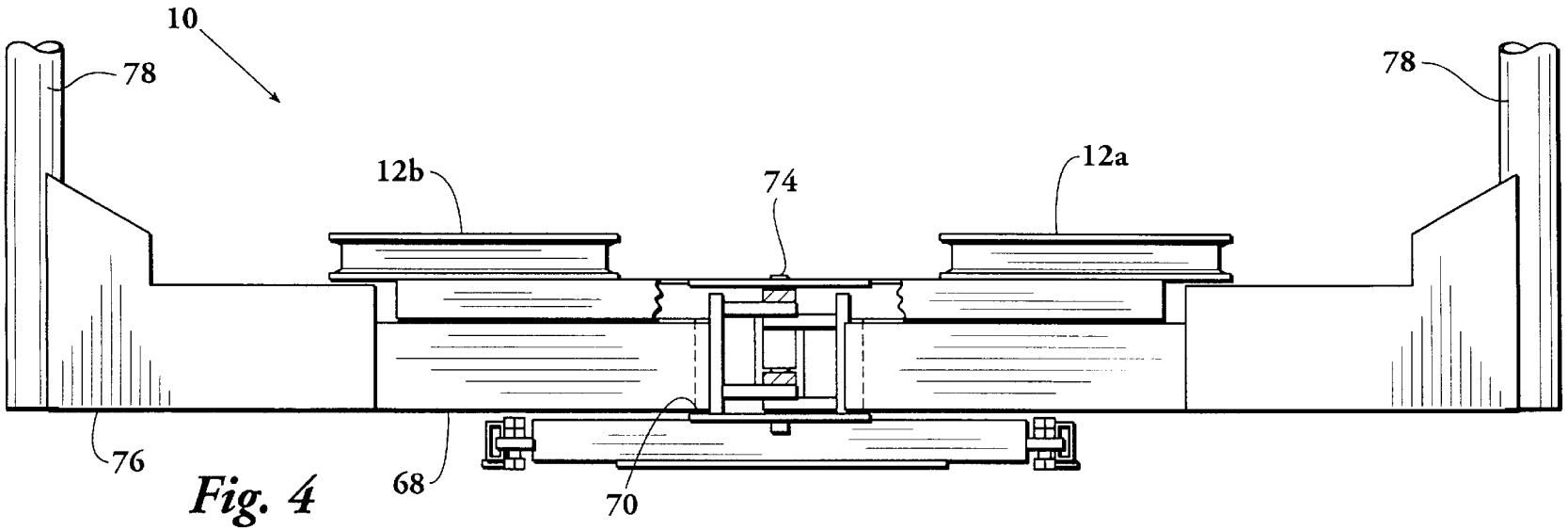
FIG. 4 is a front view of the tiltable vehicle lift.
Figure 3:
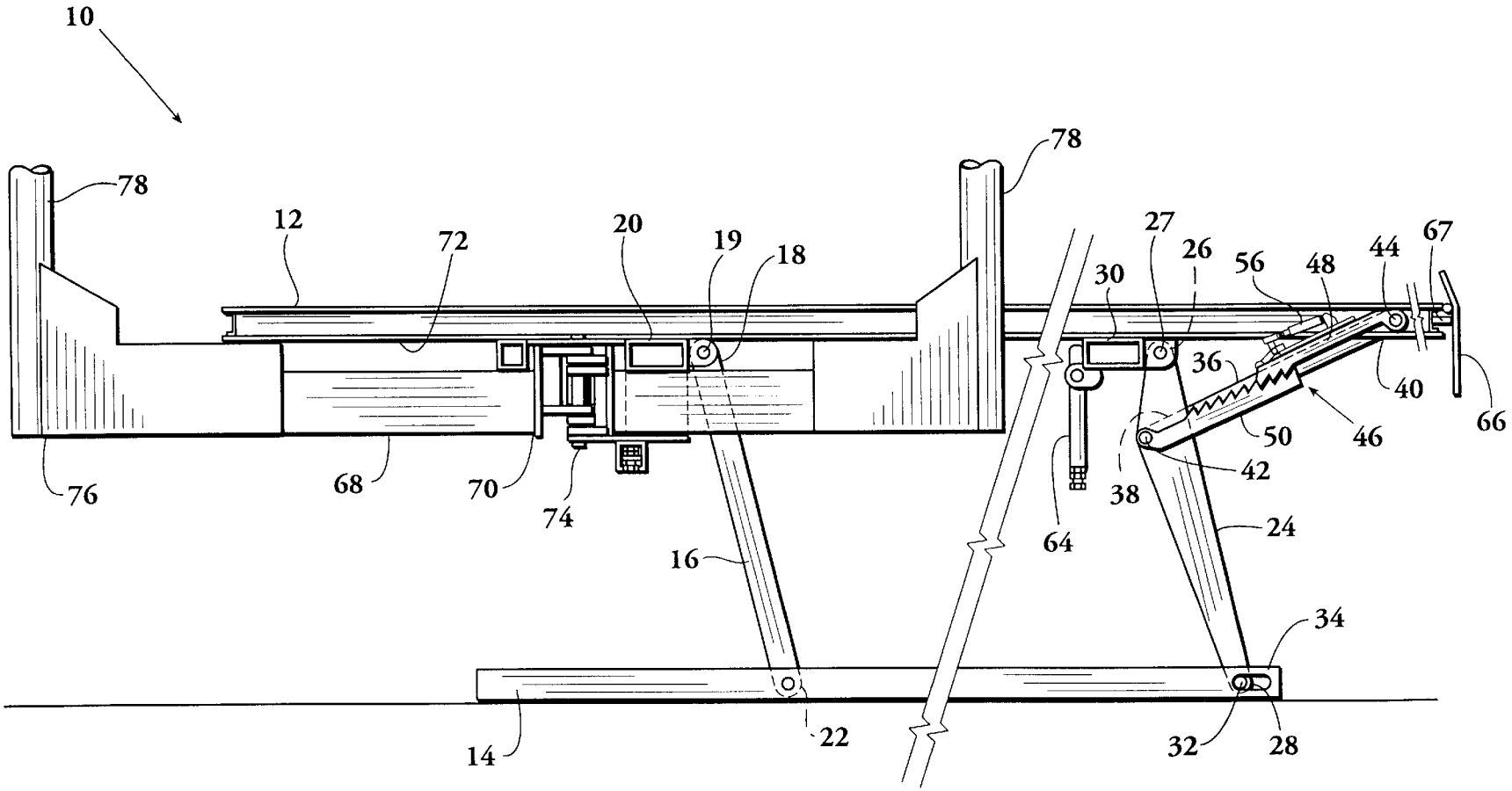
FIG. 3 is an elevation view of the tiltable vehicle lift in a third horizontal top position.
Figure 5:
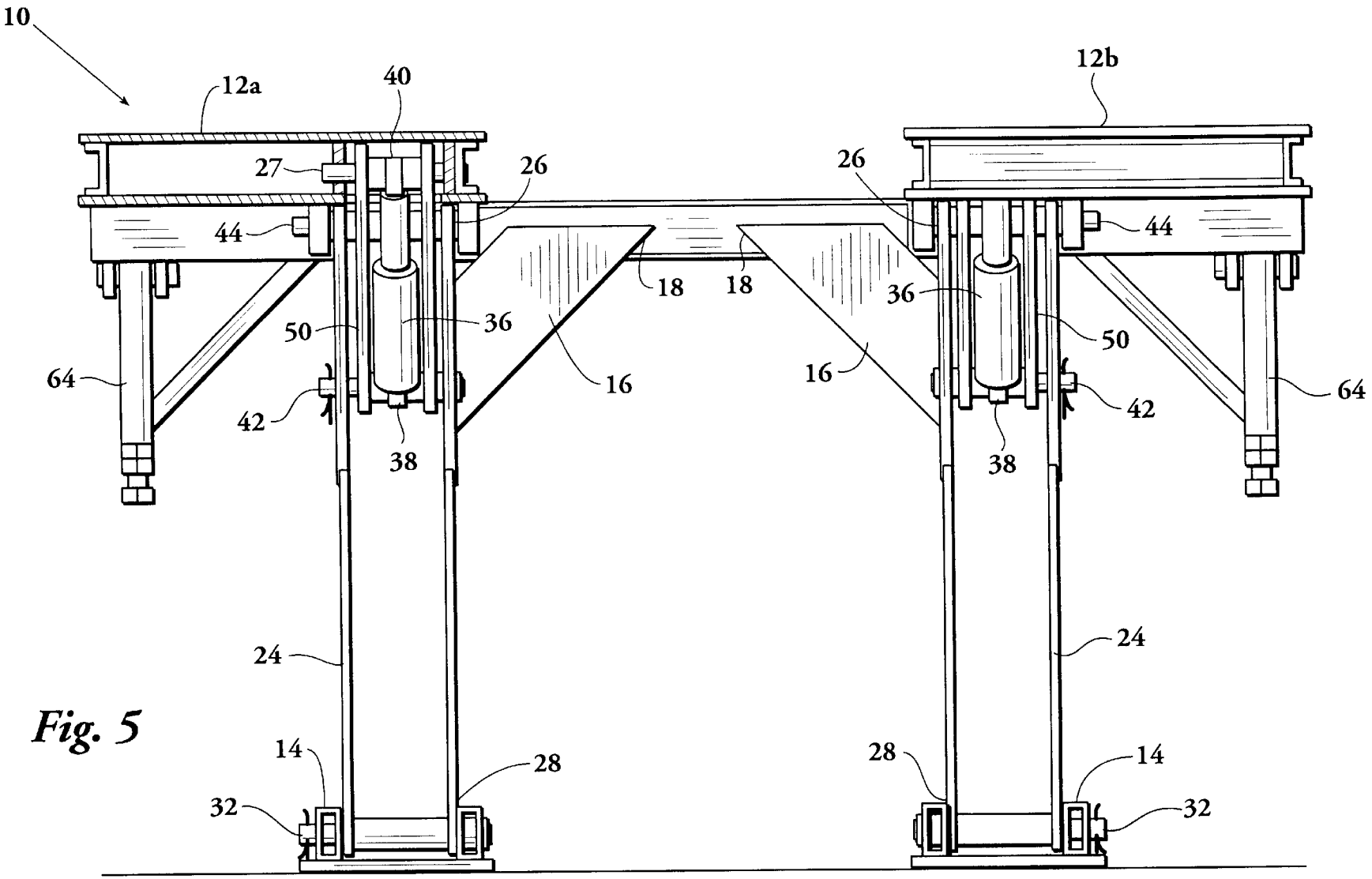
FIG. 5 is an end view of the tiltable vehicle lift in the third horizontal top position.

Referring now to FIGS. 1–5, the lift for positioning vehicles at various heights is designated by the numeral 10. Lift 10 is shown in FIG. 1 in a lowermost first position which slopes downwardly and rearwardly. FIG. 2 shows lift 10 in a second horizontal intermediate position and FIG. 3 shows lift 10 in a third horizontal top position. Lift 10 is comprised of upper treadway frame 12 having right platform treadway 12*a* and left platform treadway 12*b* for supporting a vehicle thereon. Floor piece 14 is positioned below upper treadway frame 12. Forward support 16 is pivotally affixed to upper treadway frame 12 and floor piece 14. Preferably, forward support 16 has an upper end 18 which is pivotally affixed at forward support upper attachment point 19 to upper treadway frame 12 proximate forward crosspiece 20. Lower end 22 of forward support 16 is pivotally affixed to floor piece 14.

Each of a pair of rearward legs 24 has a top end 26 and a bottom end 28. Top end 26 is pivotally affixed at rearward leg upper attachment point 27 to upper treadway frame 12 proximate rearward crosspiece 30. Rearward leg bottom end 28 is pivotally affixed to floor piece 14. Preferably, bottom end 28 is pivotally attached to floor piece 14 in a manner that provides for vertical and horizontal movement. Vertical and horizontal movement is preferably attained by means of pin 32 which is affixed to rear leg bottom end 28 and which slidably engages slot 34 fashioned in floor piece 14.

Elevation means 36 is pivotally connected at lower end 38 to rearward leg 24. Elevation means 36 is pivotally connected at upper end 40 to treadway frame 12. Elevation means 36 is for raising and lowering treadway frame 12 to and from a first position wherein treadway 12 slopes downwardly and rearwardly to a second horizontal intermediate position and to a third horizontal top position. In the preferred embodiment, elevation means 36 is a hydraulicly or pneumaticly controlled primary piston/cylinder. In the preferred embodiment, lower end 38 of elevation means 36 is attached at first attachment point 42 and upper end 40 of elevation means 36 is attached at second attachment point 44. Forward support upper attachment point 19, rearward leg upper attachment point 27, first attachment point 42, and second attachment point 44 are critical points. It is important that all holes comprising the critical points align square across right platform treadway 12*a* and left platform treadway 12*b*.

A locking mechanism, designated generally by the numeral 46, is provided to ensure that lift 10 is maintained at its desired height. Preferably, locking mechanism 46 is connected to rearward legs 24 at first attachment point 42 and is pivotally connected to treadway frame 12 at second attachment point 44. In the preferred embodiment, locking mechanism 46 is comprised of upper lock bar 48 and lower lock bar 50. Preferably, upper lock bar 48 is provided with a plurality of teeth 52 for selective engagement with teeth 54 provided on lower lock bar 50. Teeth 52 and 54 are provided so that upper lock bar 48 and lower lock bar 50 may be selectively engaged, depending upon the selected height of lift 10.

Figure 6A:
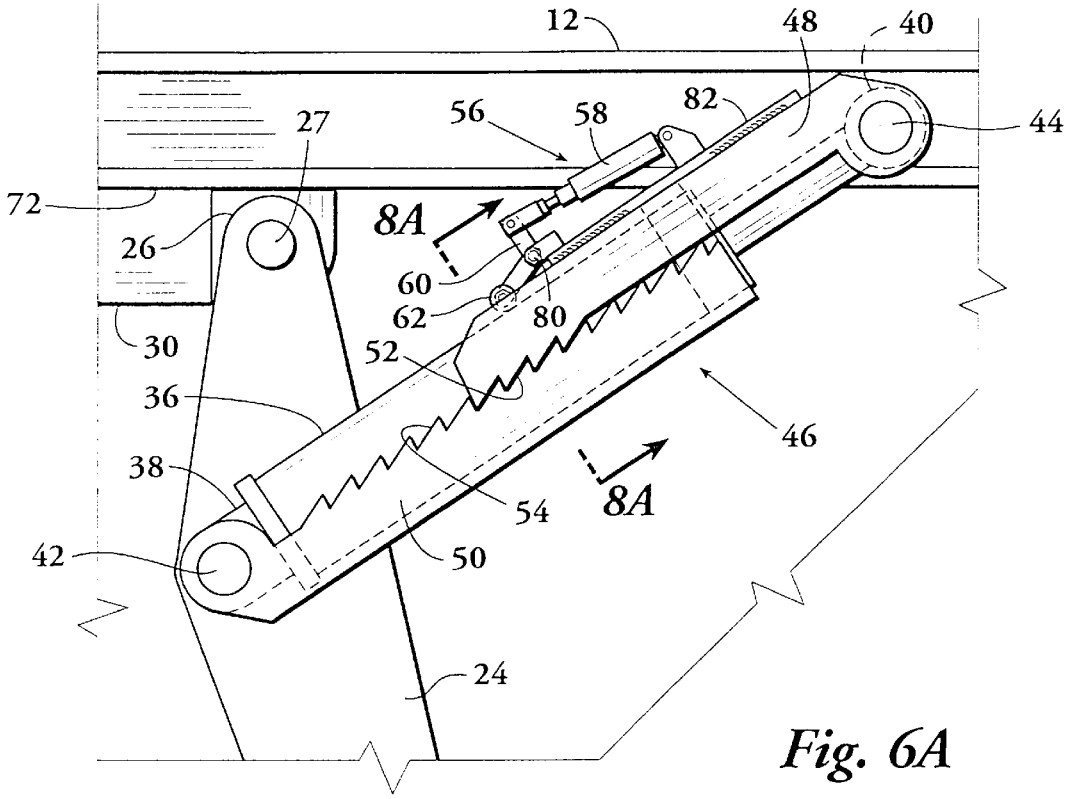
FIG. 6A is an elevation view of the locking mechanism wherein the upper lock bar is engaged with the lower lock bar.

Locking mechanism 46 is provided with disengagement means 56. Disengagement means 56 pivots upper lock bar 48 out of engagement with lower lock bar 50, thereby enabling an operator to lower lift 10. As shown in FIGS. 6*a,* 6*b,* 7*a,* 7*b,* 8*a* and 8*b,* disengagement means 56 is comprised of an auxiliary piston/cylinder 58. Auxiliary piston/cylinder 58 is preferably an air cylinder although other types of piston/cylinders will work. Auxiliary piston/cylnder 58 engages pivotally mounted arm 60. Affixed to pivotally mounted arm 60 is roller 62. Auxiliary piston/cylinder 58 manipulates arm 60, thereby engaging roller 62 onto elevation means 36. By applying a force onto elevation means 36, upper lock bar 48 is pivoted about second attachment point 44 and teeth 52 are disengaged from teeth 54.

Additional safety measures include auxiliary legs 64, which provide reinforcement to lift 10 when lift 10 is in the second horizontal intermediate position. To facilitate easier loading of lift 10 when lift 10 is in the first position, ramp 66 is provided. Additionally, stop 67 is provided to support ramp 66 so that ramp 66 will tilt outwardly upon lowering of lift 10.

Additional apparatus that may be affixed to lift 10 includes pull tower arms 68 having first end 70. Pull tower arms 68 are affixed at a first end 70 proximate forward cross piece 20 by means of pull tower hinge or rod 74. Pull tower arms 68 are affixed at second end 76 to pull tower 78. Pull tower 78 is useful for pulling a vehicle's frame and body into proper alignment when needed. Examples of devices utilizing pull tower 78 include devices described in U.S. Pat. Nos. 3,630,066, 3,888,100 and Re. 31,636, incorporated herein by reference.

Figure 7A:
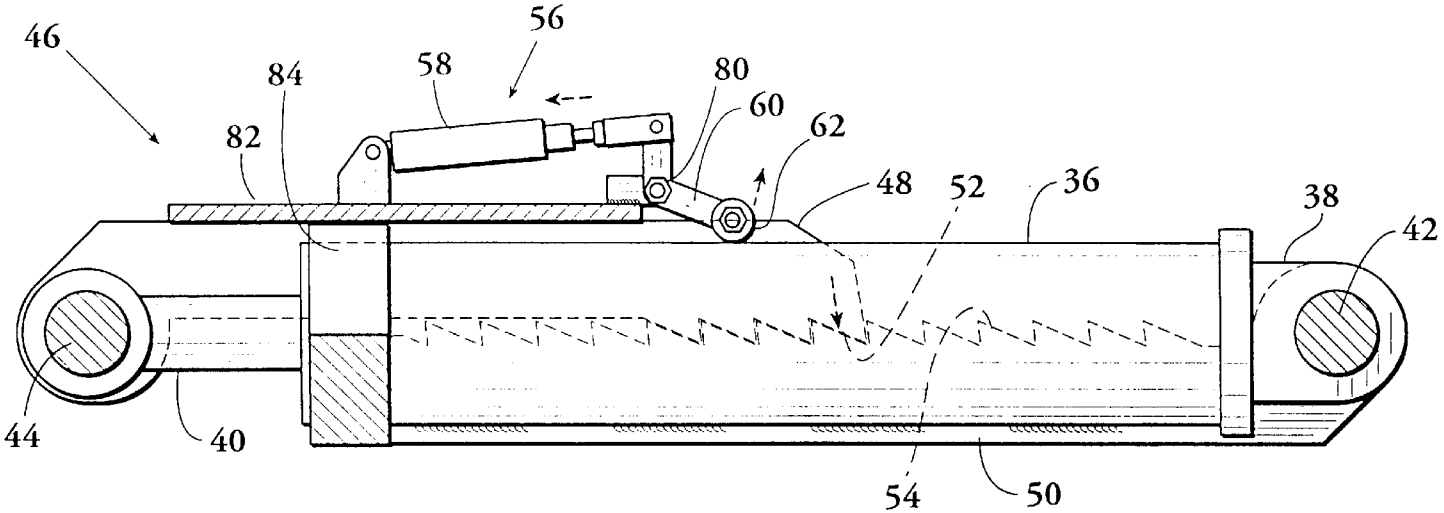
FIG. 7A is a cross-sectional view of the locking mechanism wherein the upper lock bar is engaged with the lower lock bar.
Figure 7B:
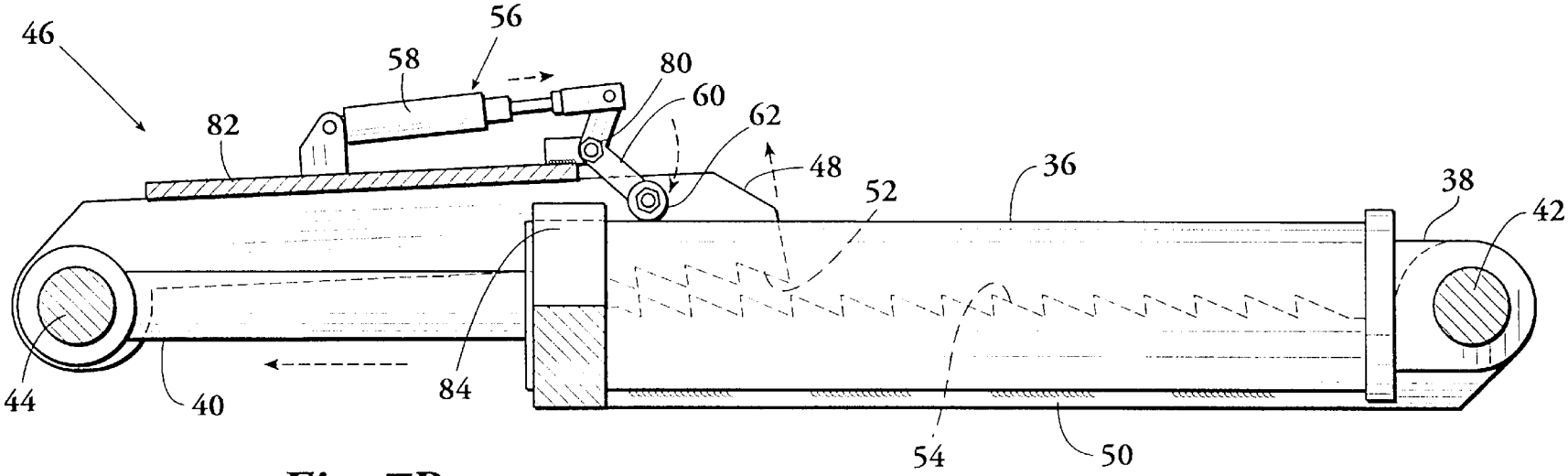
FIG. 7B is a cross-sectional view wherein the upper lock bar is disengaged from the lower lock bar.

Referring now to FIGS. 6*a,* 6*b,* 7*a,* 7*b,* 8*a* and 8*b,* locking mechanism 46 is shown in greater detail. FIG. 7*a* illustrates that upon the retraction of auxiliary piston/cylinder 58, arm 60 pivots about pivot point 80, resulting in roller 62 disengaging from elevation means 36. As a result, teeth 52 in upper lock bar 48 remain engaged with teeth 54 on lower lock bar 50. FIG. 7*b* shows that when auxiliary piston/cylinder 58 is expanded, arm 60 pivots about pivot point 80, which forces roller 62 into engagement with elevation means 36. Since pivot point 80 is rigidly affixed to upper lock bar 48 via plate 82, the engagement of arm 60 via roller 62 on elevation means 36 forces upper lock bar 48 away from and out of engagement with lower lock bar 50. Upper lock bar 48 pivots about second attachment point 44.

Figure 8A:
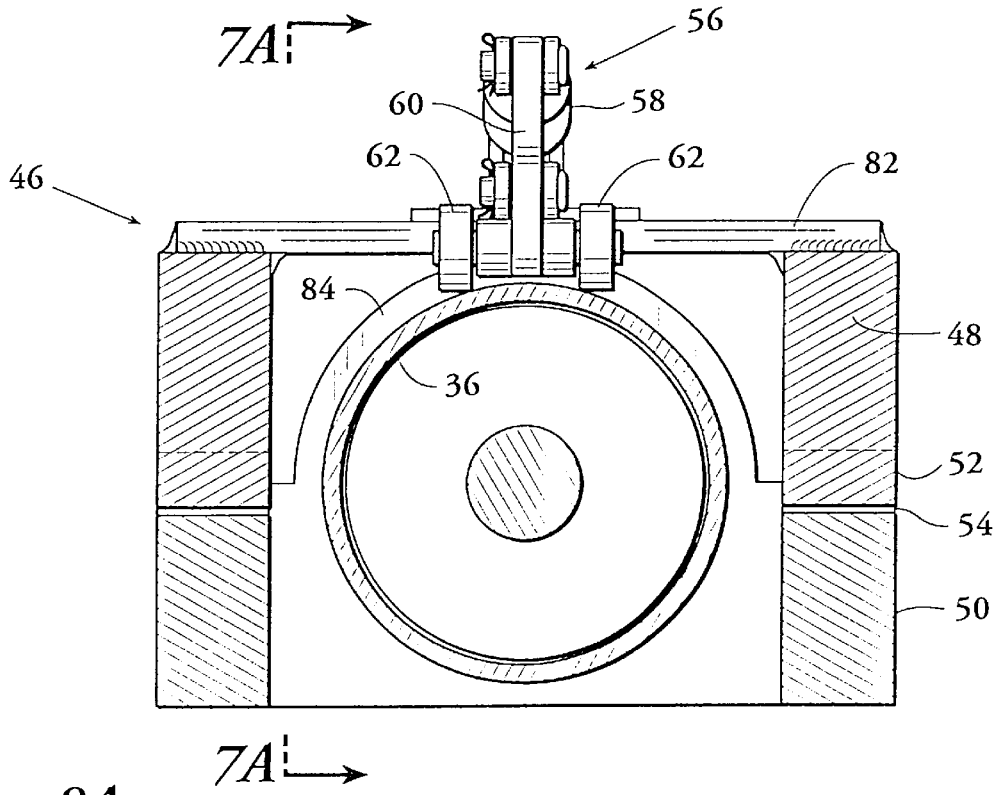
FIG. 8A is a cross-sectional view of FIG. 6*a;*.

FIG. 8*a* shows a cross-sectional view of FIGS. 6*a* and 7*a*. Disengagement means 56 is shown with auxiliary piston/cylinder 58 and arm 60 attached thereto. Roller 62 is shown in engagement with elevation means 36. In the preferred embodiment, elevation means 36 is a hydraulic piston/cylinder having a diameter of 3 5/16 inches. Plate 82 is shown welded to upper lock bar 48. An end of upper lock bar teeth 52 is visible. Lower lock bar teeth 54 are shown in engagement with upper lock bar teeth 52. Also visible is lower lock bar 50.

Figure 6B:
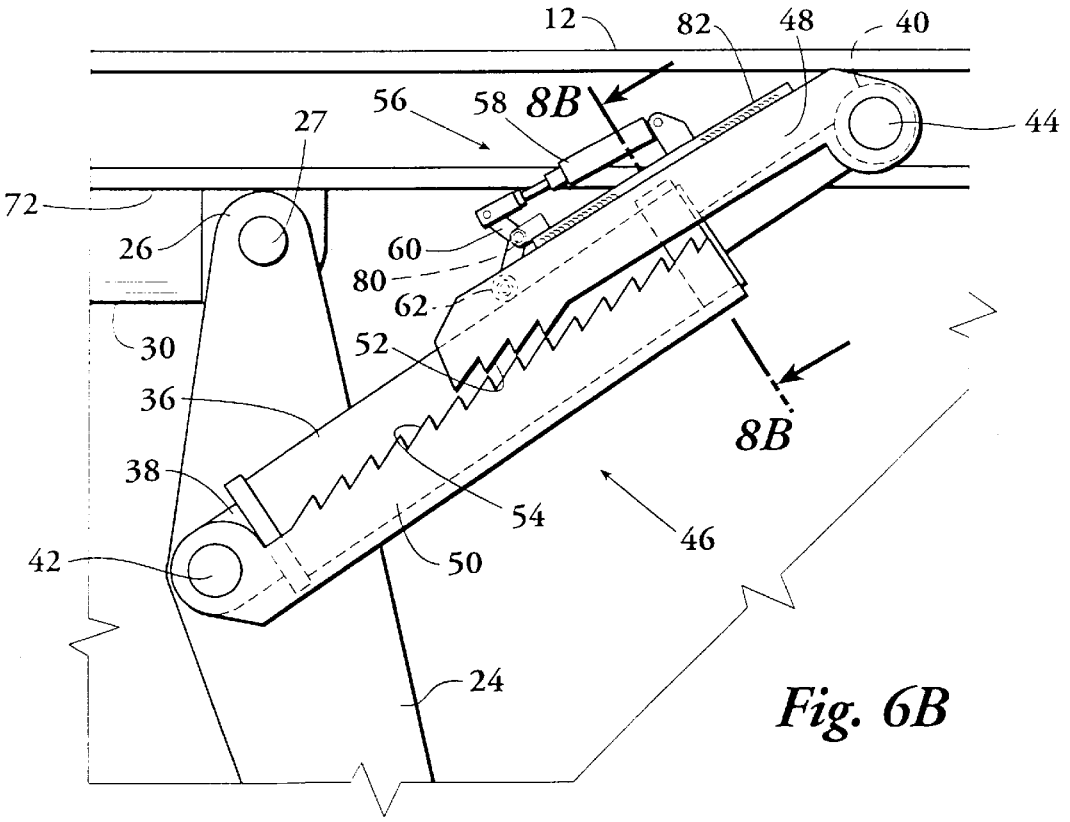
FIG. 6B is an elevation view of the locking mechanism wherein the upper lock bar is disengaged from the lower lock bar.
Figure 8B:
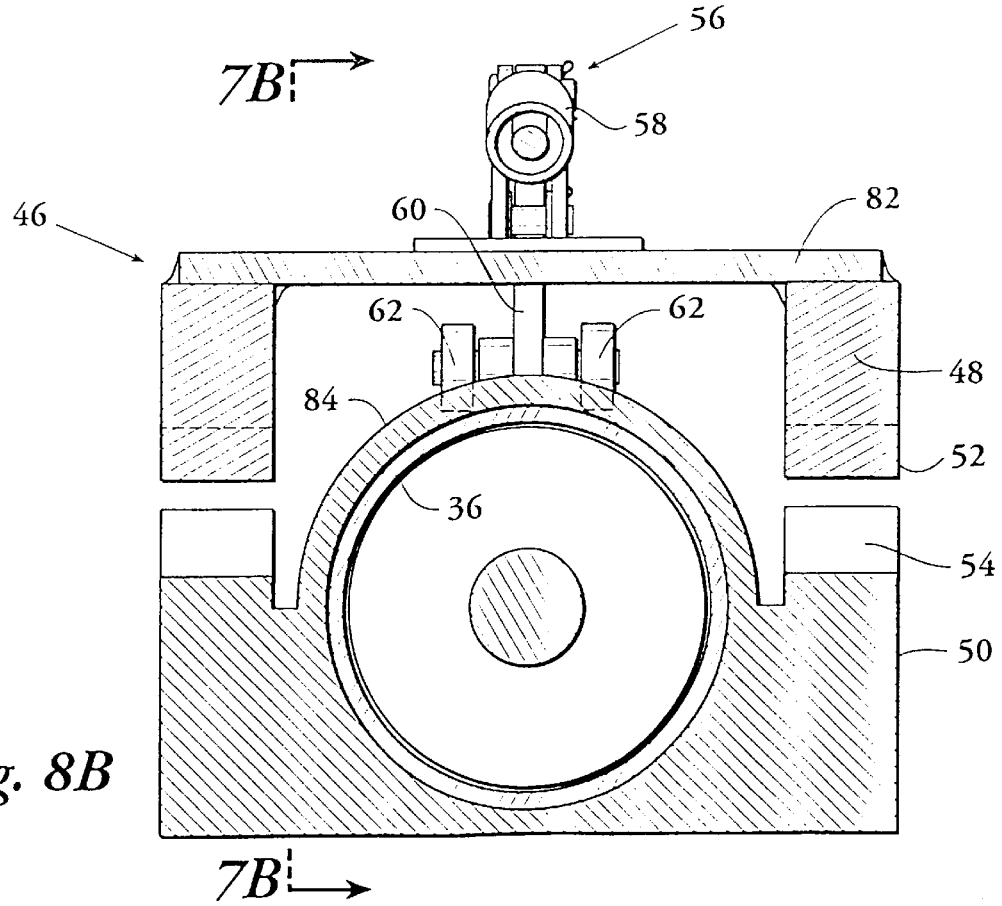
FIG. 8B is a cross-sectional view of FIG. 6*b.*

FIG. 8*b* illustrates a cross-sectional view of FIGS. 6*b* and 7*b*. Auxiliary piston/cylinder 58 is shown in cross section. Visible in FIG. 8*b* is collar 84 which secures elevation means 36 to lower lock bar 50. Upper lock bar 48 is shown disengaged from lower lock bar 50. Rollers 62, partially obscured by collar 84 and acted upon by auxiliary piston/ cylinder 58 via arm 60, are biasing against elevation means 36, resulting in the disengagement of upper lock bar 48 from lower lock bar 50.

In practice, an operator desiring to perform work on a vehicle positions lift 10 in the first position wherein upper treadway frame 12 slopes rearwardly and downward at preferably a 5½ degree tilt. Ramp 66 is provided so that the vehicle may easily be driven upon upper treadway frame 12 of lift 10. The operator then may hydraulicly control elevation means 36 to raise lift 10 to either a second horizontal intermediate position or a third horizontal top position. In the second horizontal intermediate position, auxiliary legs 64 are provided as additional safety supports. In either second horizontal intermediate position or third horizontal top position, locking mechanism 46 engages to prevent lift 10 from inadvertently being lowered due to loss of hydraulic pressure, etc. Locking mechanism 46 functions by having teeth 52 on upper lock bar 48 engage with teeth 54 on lower lock bar 50. As lift 10 is raised, teeth 52 and 54 ratchet together as upper lock bar 48 is drawn away from lower lock bar 50. However, upper lock bar 48 is lockingly engaged with lower lock bar 50 until auxiliary piston/cylinder 58 is engaged which results in the pivoting of arm 60 about pivot point 80. The pivoting of arm 60 about pivot point 80 results in upper lock bar 48 pivoting about second attachment point 44, thereby disengaging teeth 52 from teeth 54 of lower lock bar 50. After upper lock bar 48 has been disengaged from lower lock bar 50, lift 10 may be lowered.

Whereas, the present invention has been described in relation to the drawings attached hereto, it should be understood that other and further modifications, apart from those shown or suggested herein, may be made within the spirit and scope of this invention.

What is claimed is:

1. A lift for positioning vehicles at various heights for repair comprising:

an upper treadway frame for receiving and supporting a vehicle thereon;

a floor piece below said treadway frame;

a forward support having an upper end and a lower end, said lower end pivotally attached to said floor piece and said upper end pivotally attached to a bottom of said treadway frame;

a rearward leg having a top end and a bottom end, said top end pivotally attached to said treadway frame and said bottom end pivotally attached to said floor piece;

an elevation means pivotally connected at a lower end to said rearward leg at a first attachment point and pivotally connected at an upper end to said treadway frame at a second attachment point, said elevation means for raising and lowering said treadway frame;

a locking mechanism pivotally connected to said rearward leg at said first attachment point and pivotally connected to said treadway frame at said second attachment point, said locking mechanism comprised of an upper lock bar and a lower lock bar, said upper lock bar for locking engagement with said lower lock bar; and a means for disengaging said upper lock bar from said lower lock bar when said treadway frame is to be lowered.

2. A lift for positioning vehicles at various heights for repair according to claim 1, wherein said elevation means raises and lowers said treadway frame to and from a first position wherein said treadway slopes downwardly rearwardly, to a second horizontal intermediate position, and to a third horizontal top position.

3. A lift for positioning vehicles at various heights for repair according to claim 2, further comprising an auxiliary leg for supporting said treadway frame in said second position.

4. A lift for positioning vehicles at various heights for repair according to claim 1, wherein said upper lock bar has a plurality of teeth formed thereon and said lower lock bar has a plurality of teeth formed thereon, said teeth on said upper lock bar for locking engagement with said teeth on said lower lock bar.

5. A lift for positioning vehicles at various heights for repair according to claim 1, wherein said disengagement means pivots said upper lock bar out of engagement with said lower lock bar.

6. A lift for positioning vehicles at various heights for repair according to claim 1, wherein said rearward leg bottom end is pivotally attached to said floor piece for vertical and horizontal movement.

7. A lift for positioning vehicles at various heights for repair according to claim 6, wherein said bottom end of said rearward leg has a pin attached thereto, said pin for slidable engagement with a slot fashioned in said floor piece.

8. A lift for positioning vehicles at various heights for repair according to claim 1, wherein said elevation means is a hydraulicly actuated primary piston/cylinder.

9. A lift for positioning vehicles at various heights for repair according to claim 8, wherein said primary piston/cylinder is affixed at a lower end at said first attachment point and is affixed at an upper end at said second attachment point.

10. A lift for positioning vehicles at various heights for repair according to claim 9, wherein said disengagement means comprises an auxiliary piston/cylinder, said auxiliary piston/cylinder mounted on said upper lock bar, said auxiliary piston/cylinder for manipulating a pivotally mounted arm, said arm mounted on said upper lock bar, said pivotally mounted arm for engagement with said primary piston/cylinder for pivoting said upper lock bar out of engagement with said lower lock bar.

* * * * *